US010764690B2

(12) United States Patent
Gu

(10) Patent No.: US 10,764,690 B2
(45) Date of Patent: Sep. 1, 2020

(54) SPEAKER ASSEMBLY

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/527,057

(22) Filed: Jul. 31, 2019

(65) Prior Publication Data

US 2020/0045467 A1 Feb. 6, 2020

(30) Foreign Application Priority Data

Aug. 3, 2018 (CN) ..... 2018 2 1245458 U

(51) Int. Cl.

*H04R 9/06* (2006.01)
*H04R 9/04* (2006.01)
*H04R 9/02* (2006.01)

(52) U.S. Cl.

CPC ..... *H04R 9/06* (2013.01); *H04R 9/025* (2013.01); *H04R 9/045* (2013.01); *H04R 2400/11* (2013.01)

(58) Field of Classification Search

CPC ..... H04R 1/025; H04R 1/28; H04R 1/2807; H04R 1/2811; H04R 1/2869; H04R 1/2873; H04R 9/02; H04R 9/06; H04R 9/025; H04R 9/045; H04R 9/046; H04R 7/045; H04R 2400/11

USPC ..... 381/396, 398, 407, 408, 409, 411, 412, 381/418, 191; 181/171, 181

See application file for complete search history.

(56) References Cited

U.S. PATENT DOCUMENTS

| | | | | |
|---|---|---|---|---|
| 6,373,958 | B1 * | 4/2002 | Enomoto | B06B 1/0246 381/406 |
| 6,847,139 | B2 * | 1/2005 | Ueda | B06B 1/045 310/81 |
| 8,247,930 | B2 * | 8/2012 | Yamagishi | H04R 9/066 310/12.16 |
| 8,379,907 | B2 * | 2/2013 | Yan | H04R 7/04 381/396 |
| 10,362,390 | B2 * | 7/2019 | Gu | H04R 7/127 |
| 10,448,167 | B2 * | 10/2019 | Xiao | H04R 9/06 |
| 2004/0218779 | A1 * | 11/2004 | Fukuyama | H04R 9/02 381/409 |
| 2016/0021447 | A1 * | 1/2016 | Cai | H04R 1/021 381/345 |
| 2016/0112804 | A1 * | 4/2016 | Xiao | H04R 9/025 381/398 |
| 2018/0020303 | A1 * | 1/2018 | Shi | H04R 9/046 |

* cited by examiner

*Primary Examiner* — Xu Mei

(74) *Attorney, Agent, or Firm* — W&G Law Group LLP

(57) ABSTRACT

The present disclosure provides a speaker assembly. The speaker assembly includes an electrical connector, and the electrical connector includes a body part and a second pad part connected with the body part. In this way, we can measure flux or test pure tone and performance of the finished product through the second pad part during assembling of the speaker assembly of the structure, so as to prevent the body part from being scratched caused by contact in the traditional test process, thus improving the appearance yield of the finished product.

7 Claims, 4 Drawing Sheets

SPEAKER ASSEMBLY

FIELD OF THE PRESENT DISCLOSURE

The present disclosure relates to the technical field of electro-acoustic transducers, and more particularly to a speaker assembly used in a portable electronic device.

DESCRIPTION OF RELATED ART

In the related technology, the speaker assembly includes a frame, a pin, a magnetic circuit system and a vibration system contained in the frame. The pin is provided with a pin convex hull for testing.

However, after many tests, it is easy to scratch the pin convex hull, which leads to reduction of performance of the speaker assembly and poor appearance of the speaker assembly.

Therefore, it is necessary to research an improved speaker assembly with new structure to solve the problem mentioned above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
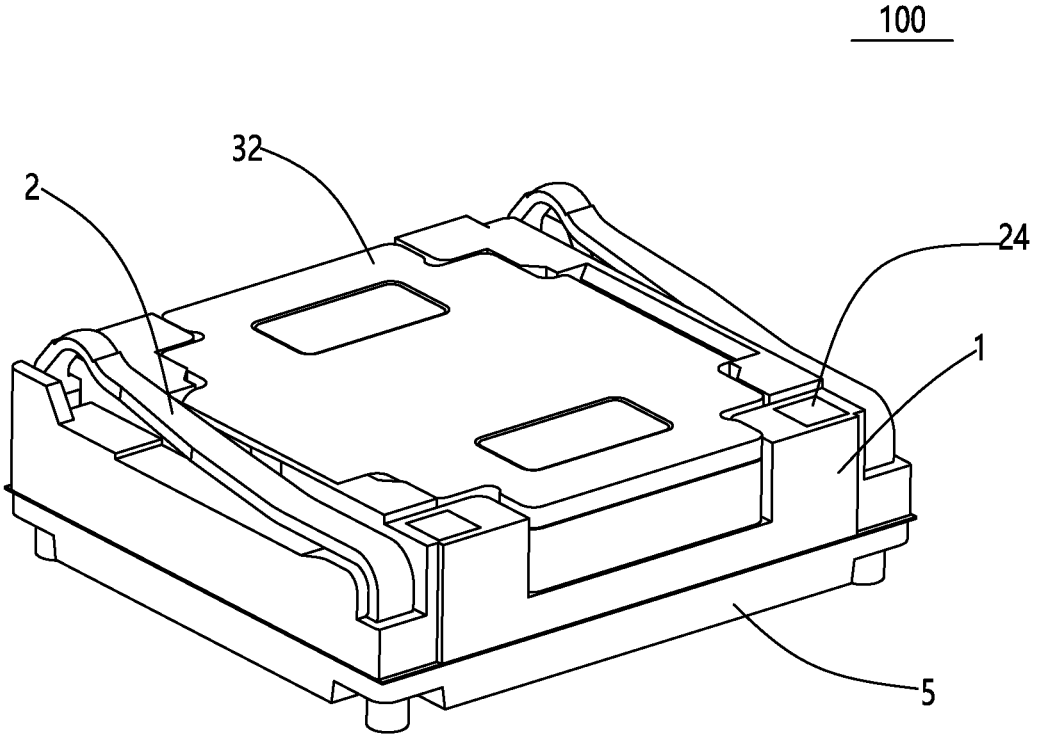
FIG. 1 is an isometric view of a speaker assembly in accordance with an exemplary embodiment of the present disclosure.
Figure 2:
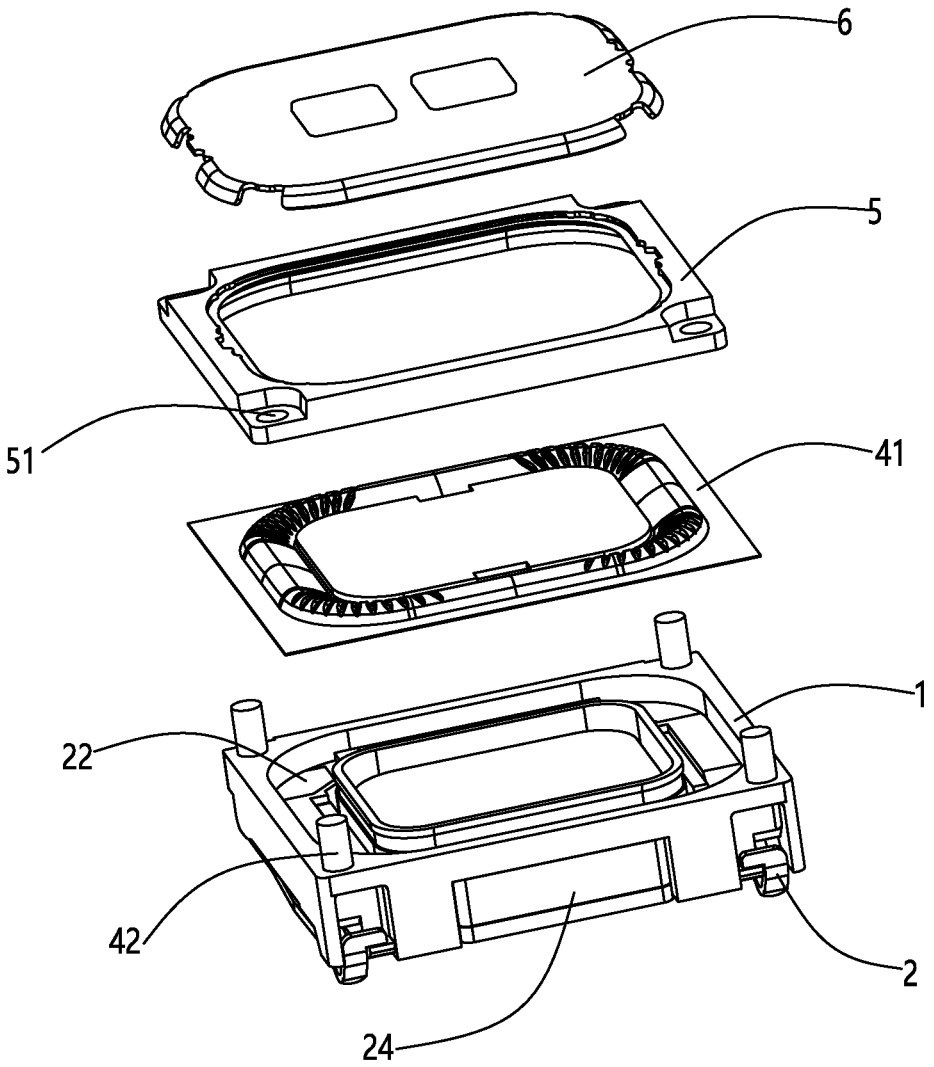
FIG. 2 is an isometric and partially exploded view of the speaker assembly in FIG. 1.
Figure 3:
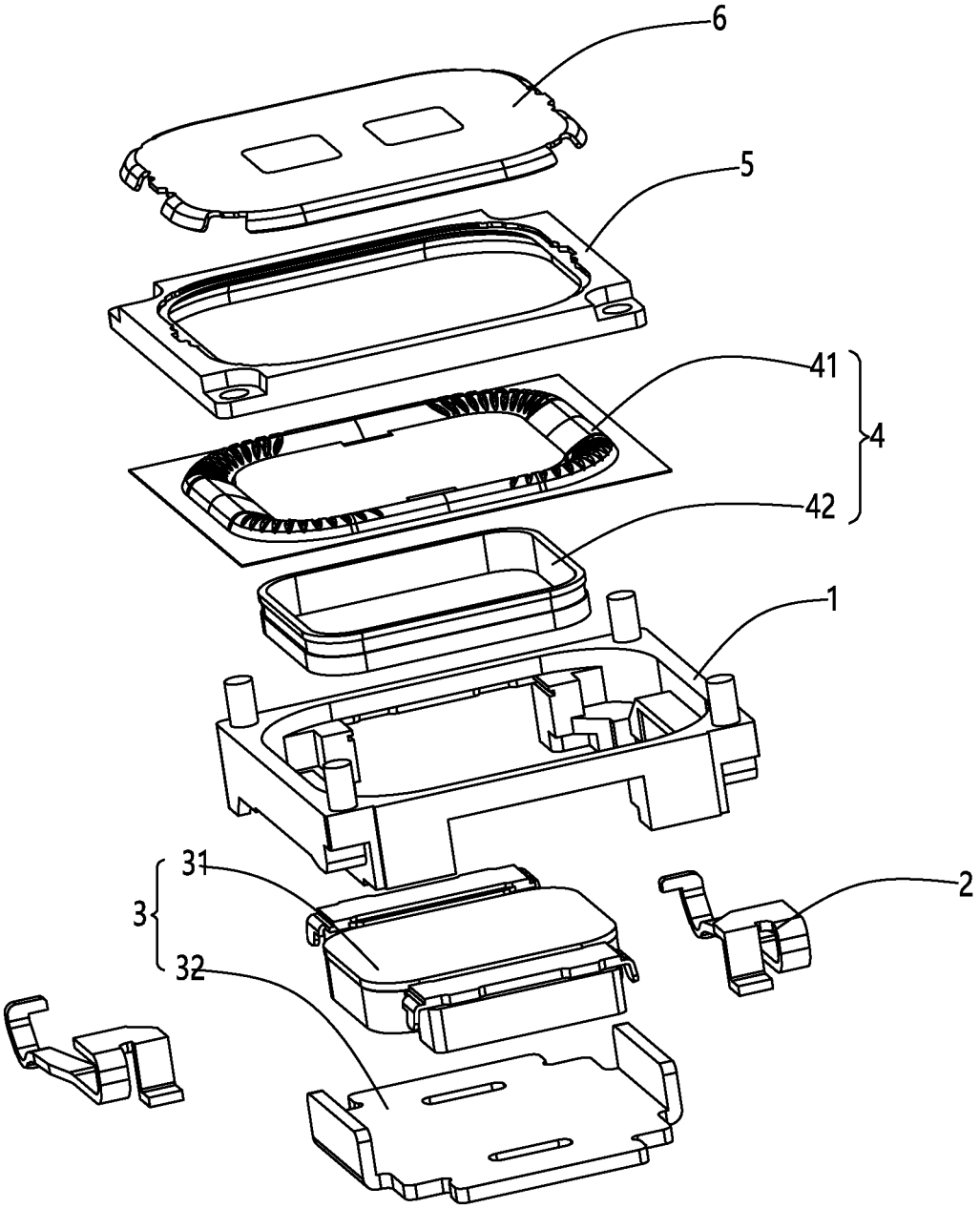
FIG. 3 is an isometric and exploded view of the speaker assembly.
Figure 4:
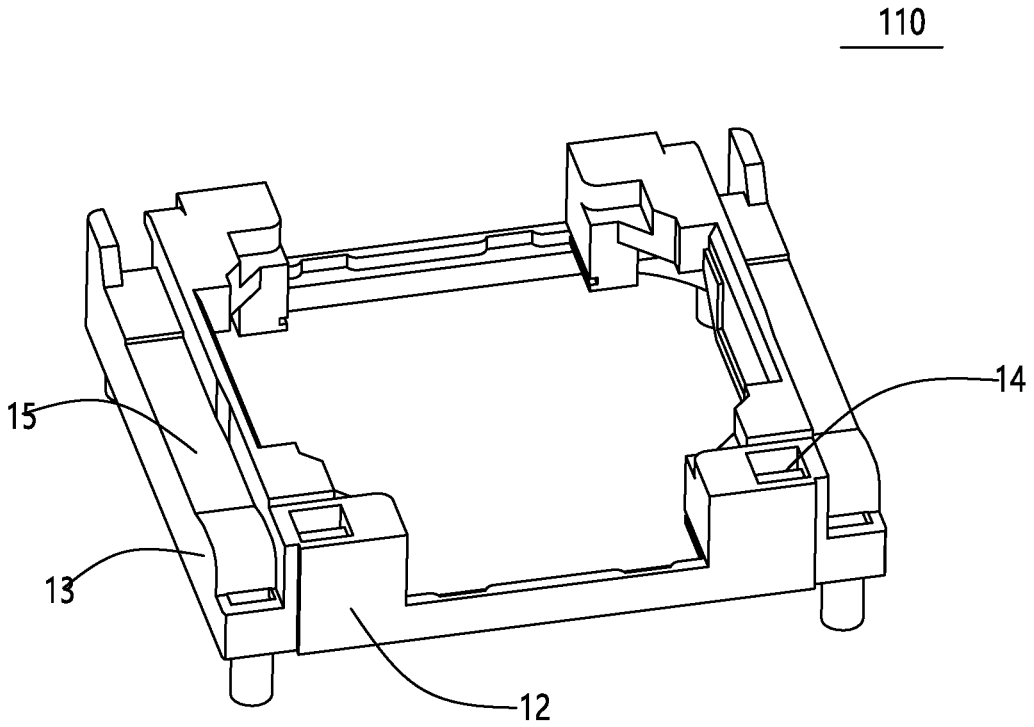
FIG. 4 is an isometric view of a frame of the speaker assembly.
Figure 5:
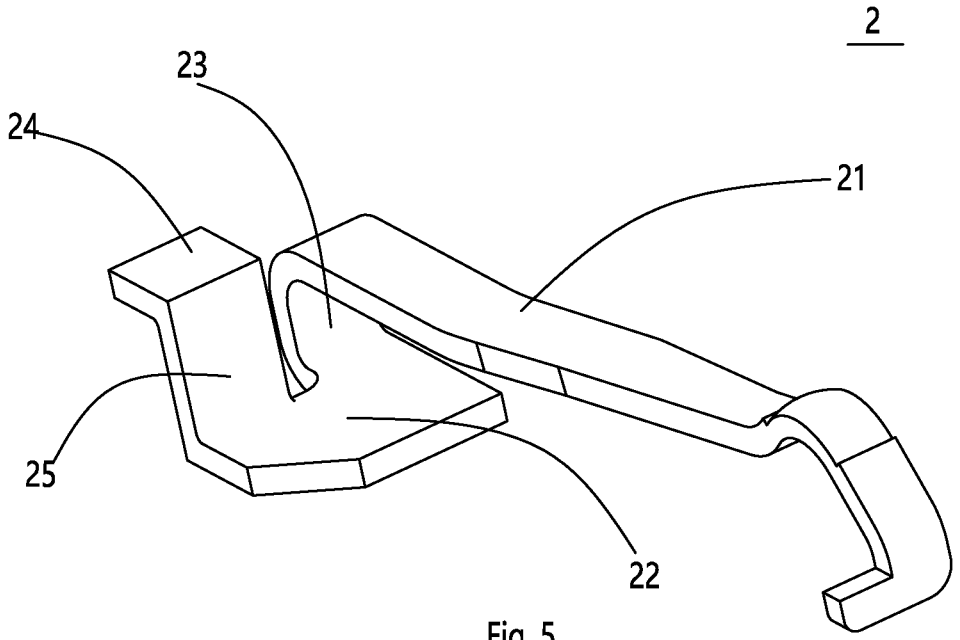
FIG. 5 is an isometric view of an electrical connector of the speaker assembly.

As shown in FIGS. 1-5, the present disclosure provides a speaker assembly 100 in accordance with an exemplary embodiment. The speaker assembly 100 comprises a housing 1, an electrical connector 2 fixed to the housing 1, a magnetic circuit system 3 and a vibration system 4 accommodated in the housing 1, a frame 5 fixed to the housing 1, and a front cover 6 disposed on the frame 5.

The housing 1 is provided with a positioning column 11 at a corner thereof, the frame 5 is provided with a positioning hole 51 at a position corresponding to the positioning column 11. The housing 1 and the frame 5 are fixed by the positioning column 11 and the positioning hole 51. The housing 1 comprises a first installation part 12 and a second installation part 13 located outside the first installation part

12. The first installation part 12 is provided with an installation hole 14 through its thickness (i.e., penetrating the first installing part 12), and the second installation part 13 is provided with a plug-in trough 15 recessed from an upper surface to a lower surface.

The magnetic circuit system 3 comprises a magnet assembly 31 and a magnetic yoke 32 for carrying the magnet assembly 31.

The vibration system 4 includes a diaphragm 41 and a voice coil 42 for driving the diaphragm to vibrate and produce sound.

The electrical connector 2 includes a body part 21, a first pad part 22 connected with the body part 21, a first connecting part 23 connecting the body part 21 with the first pad part 22, a second pad part 24 spaced apart from the first pad part 22 and a second connecting part 25 connecting the first pad part 22 with the second pad part 24. The first pad part 22 is installed on one surface of the housing 1 and electrically connected with the voice coil 42. The second pad part 24 is installed on another surface of the housing 1 and exposed outside the housing 1 for testing the vibration performance of the speaker assembly 100. The second pad part 24 penetrates the installation hole 14, and the body part 21 is inserted in the plug-in trough 15. The upper surface of the second pad part 24 and the upper surface of the installation hole 14 are coplanar with each other. The installation hole 14 can be a square hole, of course, in addition, the installation hole 14 can also be a circular hole or elliptical hole, of course, the installation hole 14 should be suitable for the second pad part 24. In addition, the second pad 24 and the installation hole 14 can be effectively fixed by transition fit or interference fit.

The speaker assembly 100 comprises two electrical connectors 2, and these two electrical connectors 2 are centrally symmetrically arranged relative to a center of the housing 1.

The speaker assembly 100 of the embodiment includes an electrical connector 2, and the electrical connector 2 includes a body part 21 and a second pad part 24 connected with the body part 21. In this way, we can measure flux or test pure tone and performance of the finished product through the second pad part 24 during assembling of the speaker assembly 100 of the structure, so as to prevent the body part 21 from being scratched caused by contact in the traditional test process, thus improving the appearance yield of the finished product.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker assembly including:

a frame;

an electrical connector fixed to the frame, including a body part, a first pad part connected with the body part and a second pad part spaced apart from the first pad part;

a magnetic circuit system;

a vibration system accommodated in the frame, including a voice coil; wherein the first pad part is installed on one surface of the frame and electrically connected with the voice coil; the second pad part is installed on another surface of the frame and exposed outside the frame for testing a vibration performance of the speaker assembly.

2. The speaker assembly as described in claim 1, wherein the electrical connector further includes a first connector connecting the body part and the first pad part.

3. The speaker assembly as described in claim 1, wherein the electrical connector further includes a second connecting part connecting the first pad part and the second pad part.

4. The speaker assembly as described in claim 1, wherein the frame comprises a first installation part and a second installation part located outside the first installation part, the first pad part and the second pad part are both installed in the first installation part, and the body part is installed in the second installation part.

5. The speaker assembly as described in claim 4, wherein the first installation part is provided with an installation hole penetrating therethrough, and the second pad part engages with the installation hole; the second installation part is provided with a plug-in trough recessed from an upper surface to an lower surface, and the body part is inserted in the plug-in trough.

6. The speaker assembly as described in claim 5, wherein the upper surface of the second pad part and the upper surface of the installation hole are coplanar with each other.

7. The speaker assembly as described in claim 1 comprising two electrical connectors and the two electrical connectors are symmetrically arranged relative to a center of the frame.

* * * * *